United States Patent [19]

Meghnot

[11] Patent Number: 4,848,609

[45] Date of Patent: Jul. 18, 1989

[54] ADJUSTABLE HOLDER FOR TV, STEREO AND VCR REMOTE CONTROL UNITS

[76] Inventor: Rupert L. A. Meghnot, 3526 Woodrun Ct., #230, Winter Park, Fla. 32792

[21] Appl. No.: 96,049

[22] Filed: Sep. 14, 1987

[51] Int. Cl.[4] ..... A47F 7/00

[52] U.S. Cl. ..... 211/13; 211/175; 248/309.1; 248/316.1

[58] Field of Search ..... 211/13, 175; 248/298, 248/309.1, 316.1, 316.4, 316.6; 273/148 B

[56] References Cited

U.S. PATENT DOCUMENTS 2,163,859 6/1939 VerBockel ..... 248/122 X
4,458,874 7/1984 Radas et al. ..... 248/670
4,712,693 12/1987 Striplin ..... 211/13 X

FOREIGN PATENT DOCUMENTS 0001944 1/1977 Japan ..... 248/298

*Primary Examiner*—Robert W. Gibson, Jr.
*Attorney, Agent, or Firm*—Edward M. Livingston

[57] ABSTRACT

An adjustable device for holding together any two remote television (TV), stereo and video cassette recorder (VCR) monitor control units. The device consists of two interconnecting pieces having sides with gripping means for firmly holding the monitors in place, bottom portions which interconnect by tongue and groove means and upper portions having matching teeth and grooves for adjustably interconnecting the two pieces to hold any two sizes of controls. The device can be easily held in one hand, thereby leaving the other hand free to operate the TV, stereo and VCR remote control units at the same time. This device prevents remote control units from being misplaced and protects said units from damage due to dropping.

5 Claims, 4 Drawing Sheets

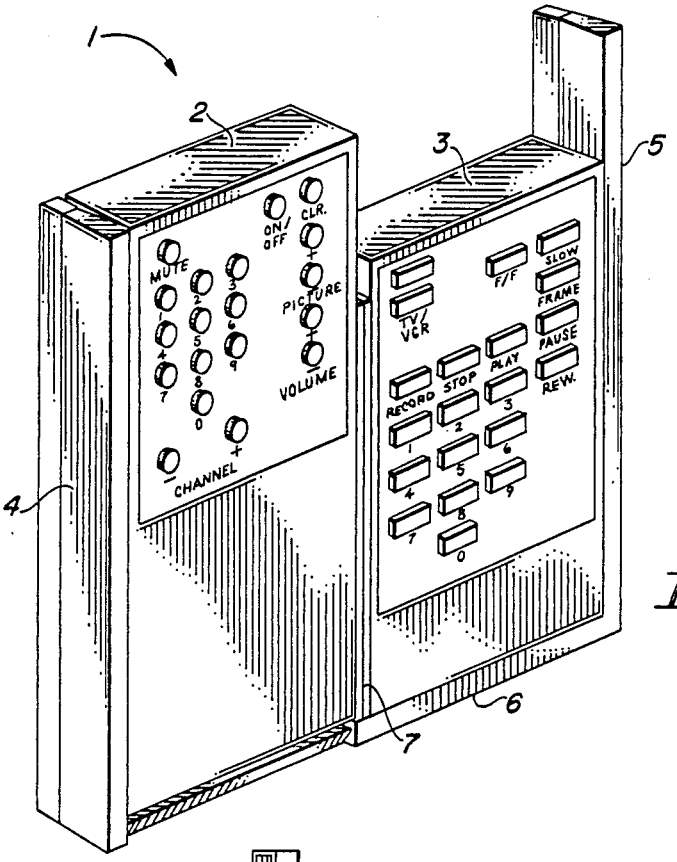
FIG. 1
FIG. 5
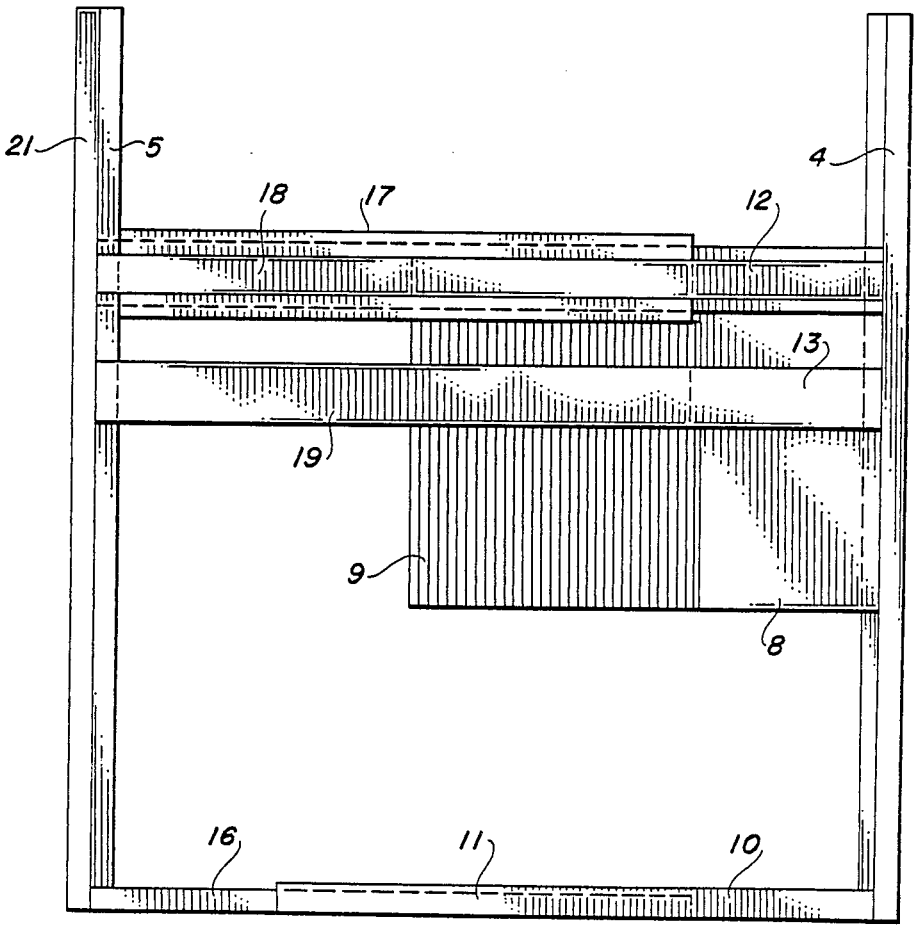

ADJUSTABLE HOLDER FOR TV, STEREO AND VCR REMOTE CONTROL UNITS

BACKGROUND OF THE INVENTION

This invention relates to remote TV, Stereo and VCR control units and more particularly to holders for such devices.

The prior art is replete with many monitors that remotely control only TV and VCRs from a single device, such as U.S. Pat. Nos. 4,626,847 and 4,527,204. Still others teach controlling multiple appliances from a single hand-held unit such as U.S. Pat. Nos. 4,394,691; 4,488,179; 4,496,947; and 4,274,082. However, none of these patents disclose a device for holding separate remote control units for TVs, Stereos and VCRs together. These sophisticated dual electronic remote control units which are disclosed or which can be purchased to control a TV, Stereo or VCR from one unit are expensive and can be only used for a TV which is programmable to allow for same, which is not the case with many older television sets.

Currently, when consumers purchase TVs and VCRs, they get two separate remote control monitors, one for the TV and the other for the VCR. Very few stereo systems even offer hand-held remote monitoring units. These monitors are usually different sizes and must be operated separately. Such separate monitor units are misplaced or lost, and thus cannot always be found when needed. Moreover, the units can be easily dropped and damaged since they are not cushioned or otherwise protected in a holder.

Thus, it is the purpose of the instant invention to provide a device for holding separate remote control monitoring units for TVs, Stereos and VCRs, that is adjustable, easy to use, sturdy and inexpensive. This device can be made with durable material, such as plastic, and is adjustable by means of interconnecting teeth and grooves in the two pieces of the device which enables any two sizes of monitors to be held and protected.

SUMMARY OF THE INVENTION

The primary object of this invention is to provide a device for holding separate TV, Stereo and VCR remote control monitor units in one place.

The second object of this invention is to provide such a device which is adjustable to hold any two sizes of such remote control units.

Another object of the invention is to provide such a device which is easy to use.

An even further object of this invention is to provide a device which protects TV, Stereo and VCR monitor units from damage.

An additional object of the invention is to provide such a device which is sturdy and durable.

An even further object of this invention is to provide a device which meets all the above objects that is inexpensive to make it affordable by almost any consumer.

This invention accomplishes the above and other objects by providing a device having two pieces which are interconnected by a series of matching grooves and teeth. A back portion enables this holder to rest on the arm of a couch or sofa or any other relatively flat surface, making it easy to locate. The device is adjustable by means of interconnecting teeth and grooves on the two pieces that may be pulled apart merely by pressing inward on the back portion of the device so that the monitors may be inserted and then pushing the two pieces inward so that the teeth interlock in a position whereby the remote units are held firmly in place. The device protects the TV, Stereo and VCR monitors from damage caused by being dropped or other reasons because it wraps around the sides of the monitors and does not come apart when dropped. The device may be made of molded plastic or other material for durability. Finally, the device is inexpensive and offers great savings to the consumer since it is not too complex in design and enables the owners of TVs, Stereos and VCRs to utilize separated remote control units rather then purchasing expensive remote control units.

Other objects, features and advantages of this invention will become more readily apparent from the detailed description of the preferred embodiment hereinafter in conjunction with reference to the drawings appended to this application.

BRIEF DESCRIPTION OF THE DRAWINGS

The drawings appended to this application are as follows:

FIG. 1 is a perspective view showing the invention in use with a TV monitor and a VCR monitor in place;

FIG. 5 is a rear plan view of the device;

DETAILED DESCRIPTION OF THE PREFERRED EMBODIMENT

Figures 2, 3, 4, 6:
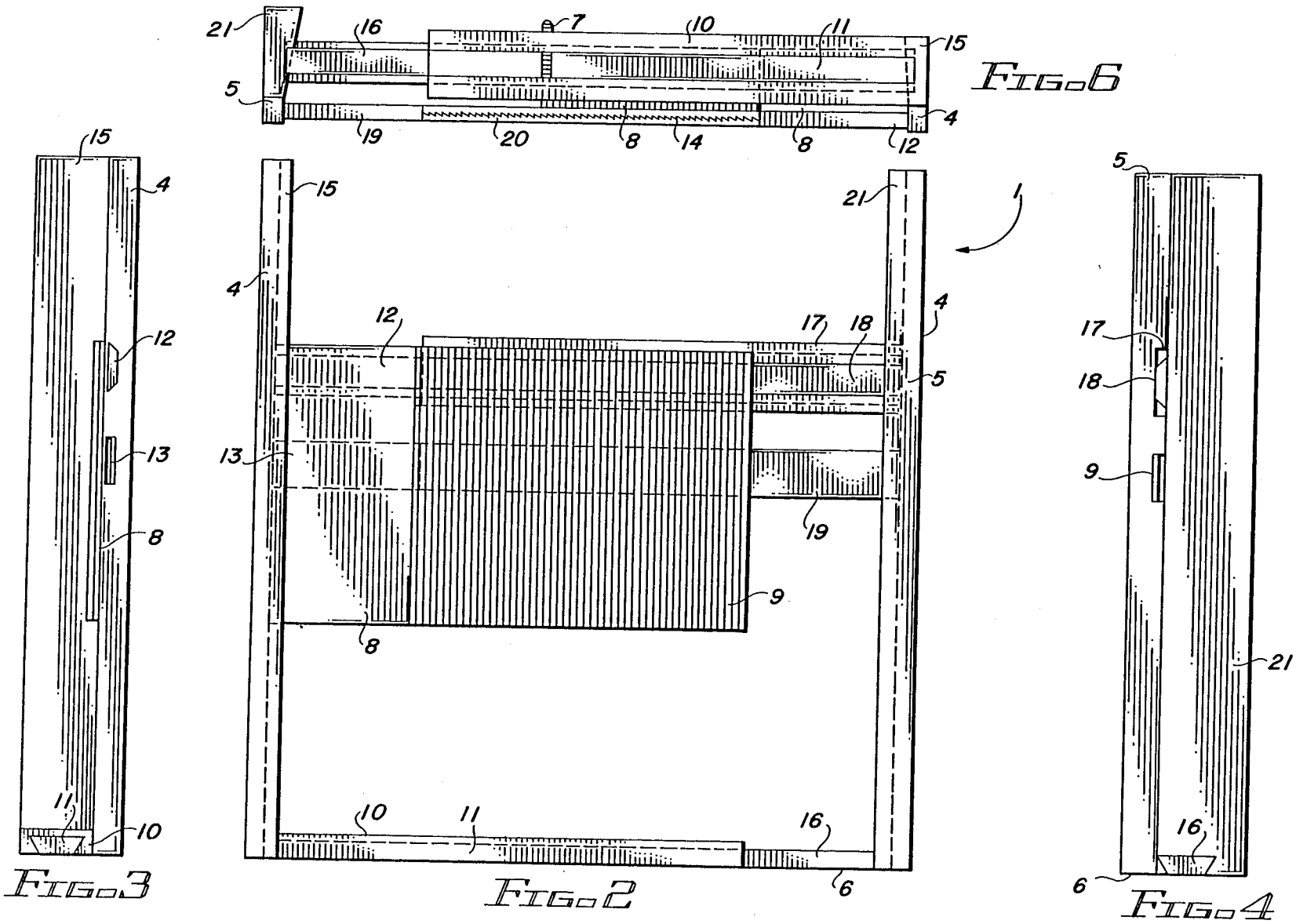
FIG. 2 is a front plan view of the device itself.
FIG. 3 is a plan view of the left side of the device.
FIG. 4 is a plan view of the right side of the device.
FIG. 6 is a bottom plan view of the device.
Figure 12:
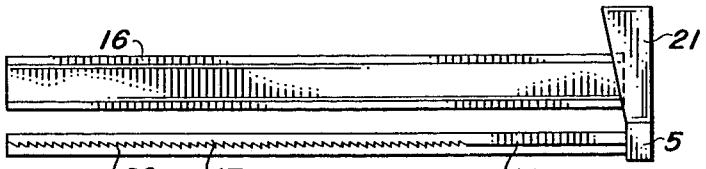
FIG. 12 is a bottom plan view of the second section of the device.
Figure 11:
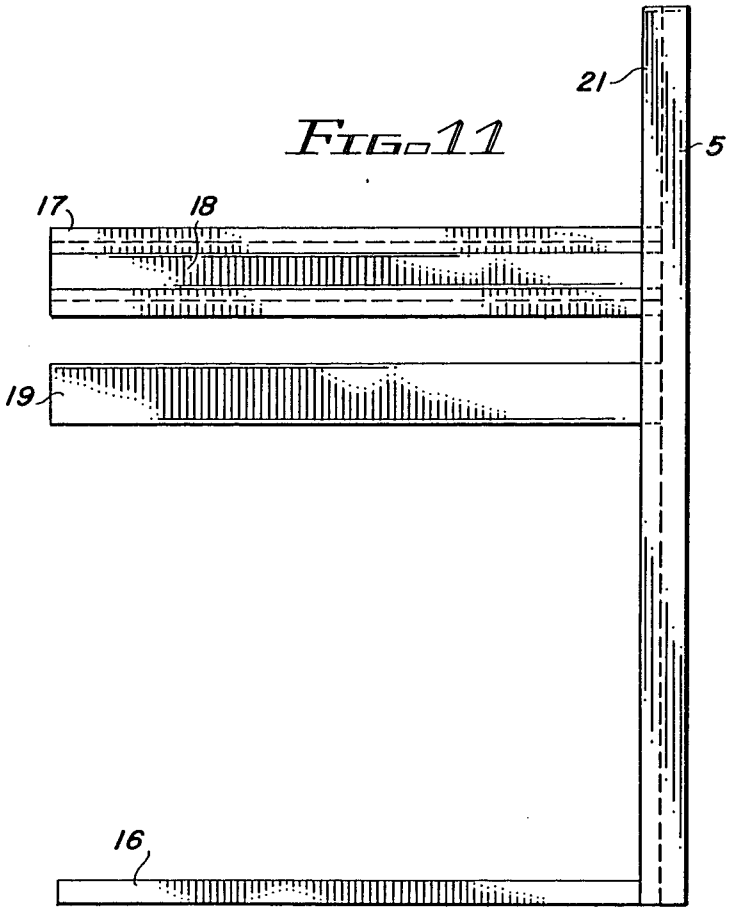
FIG. 11 is a front plan view of the other piece of the device referred to as the second section.
Figure 8:
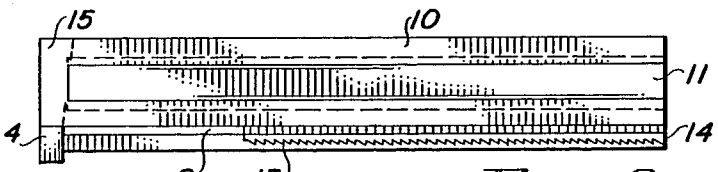
FIG. 8 is a bottom plan view of the first section of the device shown in FIG. 7.
Figure 7:
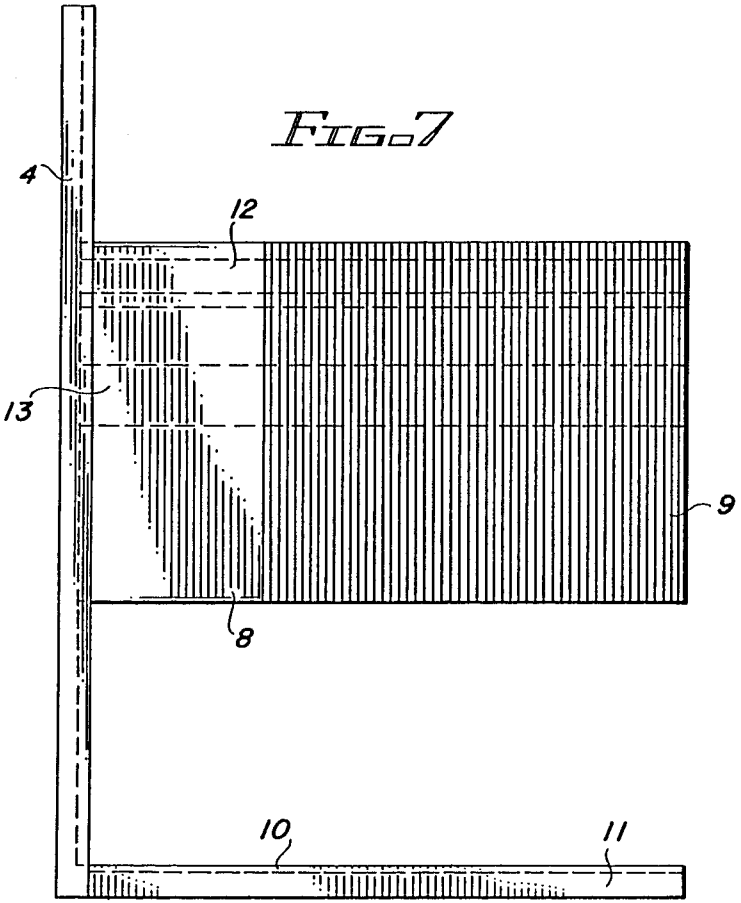
FIG. 7 is a front plan view of one piece of the device referred to as the first section.
Figure 10:
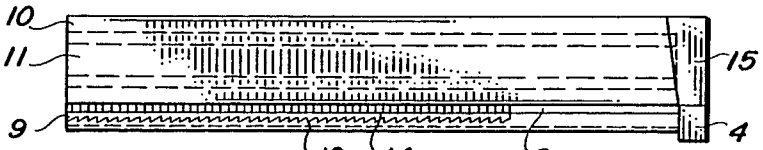
FIG. 10 is a top plan view of the first section of the device.

Referring now to the drawings appended to this application, the device itself is indicated generally by numeral 1. In FIG. 1 the device is illustrated in actual use holding both a thinner TV monitor 2 and a thicker VCR monitor 3 in place. These two monitors could be any combination of TV, VCR and Stereo remote units available. The two sides of the device indicated by 4 and 5 have gripping means 15 and 21 as part of the sides 4 and 5 which are tapered edges in which to wedge the units into place, keeping them together in the event the device is dropped. The bottom of the device 6 also supports the monitors. In FIG. 1, a portion of the teeth section in the center 7 is also illustrated.

FIGS. 2, 3, 4, 5 and 6 show plan and side views of the device itself without the remote control units. In these views, in addition to the components shown in FIG. 1, the bottom of the device 6 is seen to consist actually of a female perpendicular extension 10 on side 4 having a hollow slot 11 along its length into which a male extension 16 from the second side 5 of the device can be inserted. FIGS. 5 and 6 which illustrate the rear plan view of the device, shows the back teeth 14 facing inward toward the units, of the arm 13 which interlock with the teeth 20, facing outward away from the remote units of the arm 19. The two sides of the device 4 and 5 interlock by means of series of teeth 14 and 20 longitudinally displaced along the upper strips 13 and 19, which interlock with teeth 14 on arm 13 facing inward towards the remote monitoring these teeth 14 then interlock with teeth 20 on arm 19, which face outward from the units. Two arms 12 and 17 appear in back of the upper portion 8. The two strips 12 and 16 are inserted into the grooves 17 and 11 respectively, so the teeth 14 and 20 interlock at the desired position behind the remote monitor units 2 and 3, thus squeezing the remote units 2 and 3 together, on either side of the center support 7.

Figure 9:
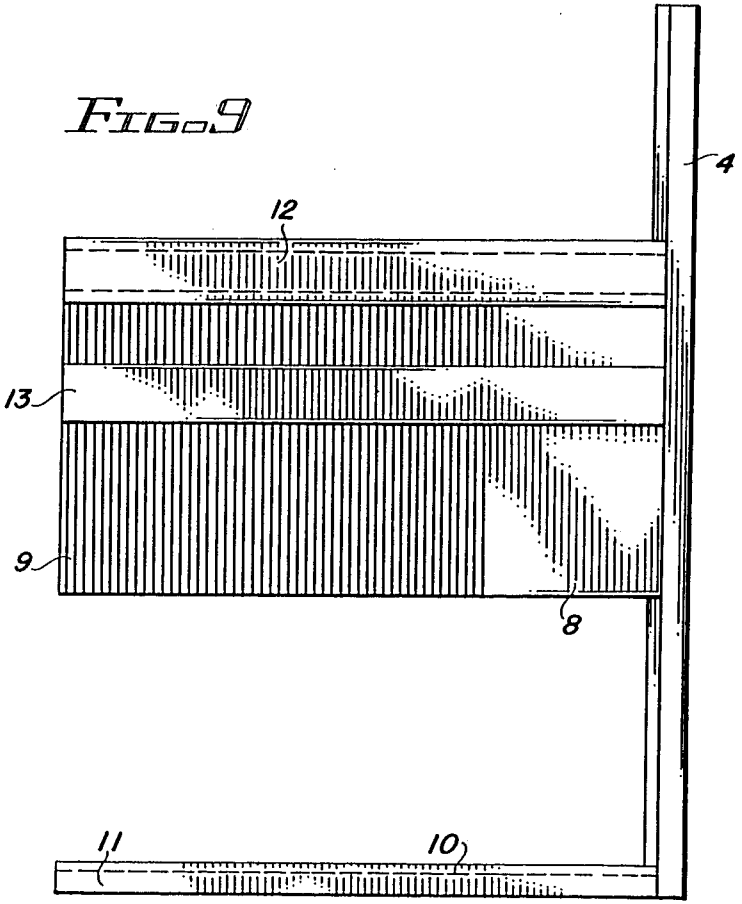
FIG. 9 is a rear plan view of the first section of the device.
Figure 14:
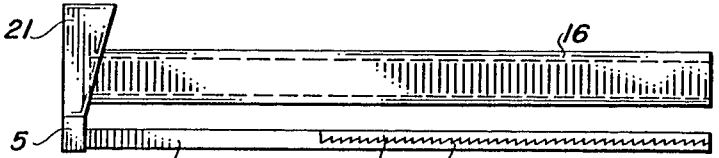
FIG. 14 is a top plan view of the second section of the device.
Figure 13:
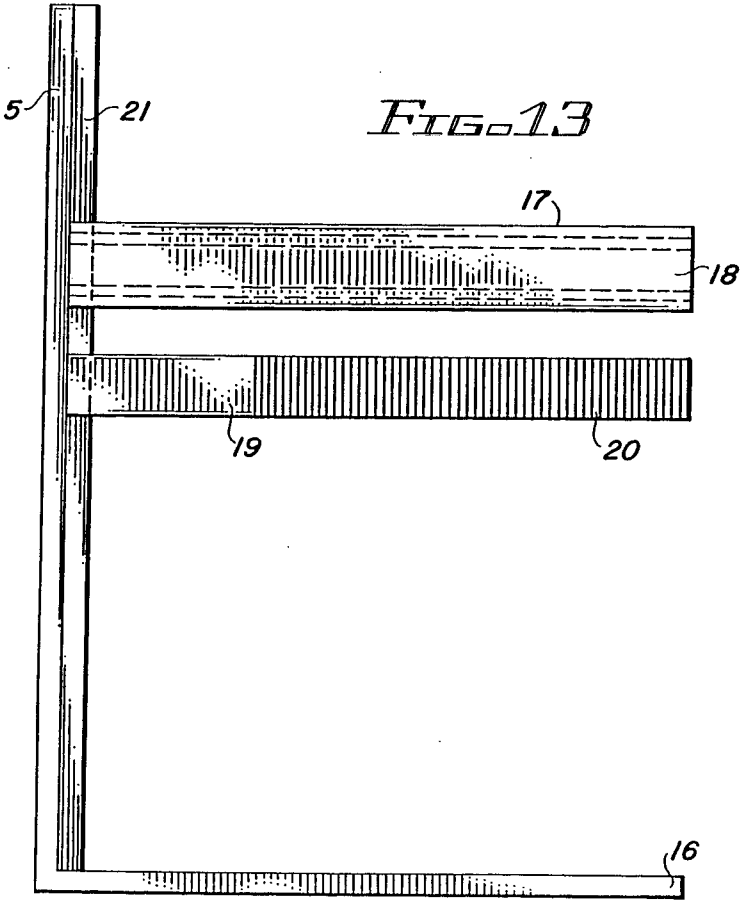
FIG. 13 is a rear plan view of the second section of the device.

FIGS. 7 through 10 show various views of the first side 4 of the device and FIGS. 11 through 14 show the interconnecting second section 5 of the device. In the bottom and plan views of FIGS. 7 and 8, the teeth 14 are seen to be displaced longitudinally along the tooth connecting arm 15 with the male extension 12 above it, both being behind the back support 8 and for insertion of the matching female piece 17 in the toothed connecting arm 19, of the second section 5 of the device. The rear view of FIG. 9 shows the backside of the first section 4 showing the longitudinal grooves 9, the placement of the toothed connecting arm 13 and the male extension 12 above it and behind the back support 8. FIGS. 11 through 14 show the second section of the device from the front, rear, top and bottom plan views, including the teeth 20, which interconnect with the matching grooves 14 on the other section of the device.

The operation of the device probably can best be described with reference to FIGS. 1 and 2 of the drawings. First, before inserting the monitor units 2 and 3 the device must be made sufficiently wide by simultaneously pulling down on the toothed connecting arm 19 of the second section 5 while pulling the two sections outward away from each other. Once the device is wide enough, the remote units 2 and 3 can be placed next to each other. The first remote 2 is placed on top of the back support 8 and resting atop the female extension arm 10 at the bottom. The grooves on 8 then permit it to be bent upward against the side of the unit 2 and between the two units, providing a center support 7. The second unit 3 is placed atop the male extension 16 and over the arms 17 and 19 of side 5. Then the two section of the device may be pushed inward toward each other until the remote units 2 and 3 are held snugly in which position the teeth and grooves on both sections will interlock so that the device will not come apart in use. The tapered shape of the two side supports 15 and 21 wedge the two units in place.

As mentioned previously, the tooth sections of the device must be made of sturdy but flexible material, such as molded plastic.

From the above detailed description it should be apparent that this device offers numerous advantages and benefits not available in the prior art. One overall benefit is that the device enables the user to have two separate different size TV, Stereo and VCR monitor control units in one place. Another benefit is that the device is adjustable to fit any two sizes of remote control units that are made so that if a TV, Stereo or VCR is purchased with remote control units the two sections of the device can be easily pulled, the new dropped in and snapped together again. The sturdy and durable device protects such expensive remote control units from being dropped and damaged. The size and shape of the device allows it to be easily located by placing it on the arm of a couch, chair or table, thus preventing the common occurrence of having remote control units falling down into hard-to-reach areas. Finally, this device offers all the above advantages and benefits, while still being affordable for the consumer, contrary to the sophisticated dual electronic units which are currently sold on the market.

It should be understood that various changes or modifications may be made to the invention without departing from the spirit and scope of the invention described herein and as set forth on the claims hereinafter.

Having described in detail my invention, I claim the following:

1. An adjustable device for holding two separate remote control units for any television, stereo system and video cassette recorder comprising:

a first section having a narrow vertical side, a bottom portion connected at the bottom of said side having a slot therein, an upper portion attached to the back of said side extending from said side in the same direction as said bottom portion, said upper portion having means of adjustable interconnecting with a second section; and a second section interconnected with said first section having a narrow vertical side, a bottom portion which is insertable in the slot of the bottom portion of the first section and an upper portion extending therefrom with means of adjustably interconnecting with the upper portion of the first section.

2. The device of claim 1 wherein the means for adjustably interconnecting the first and second sections consist of a series of teeth longitudinally displaced along the upper portions thereof with a slot and groove vertically displaced in the upper portion of the first section and two extensions in the upper portion of the second section, one extension having teeth longitudinally displaced thereon which interconnect with the teeth in the first section, and the other extension shaped to fit in the slot in the first section.

3. An adjustable device for holding two separate remote control units from a television, stereo system and video cassette recorder comprising:

a first section having a narrow vertical side with holding means, a bottom portion connected at the bottom of said side having a slot therein, an upper portion attached to the back of said side extending from said side in the same direction as said bottom portion, said upper portion having means of adjustable interconnecting with a second section; and a second section interconnected with said first section having a narrow vertical side with holding means, a bottom portion which is insertable in the slot of the bottom portion of the first section and an upper portion extending therefrom with means of adjustably interconnecting with the upper portion of the first section.

4. The device of claim 3 wherein the means for adjustably interconnecting the first and second sections consist of a series of teeth longitudinally displaced along the upper portions thereof with a slot and groove latitudinally displaced in the upper portion of the first section and two extensions in the upper portion of the second section, one extension having teeth longitudinally displaced thereon which interconnect with the teeth in the first section, and the other extension shaped to fit in the slot in the first section.

5. The device of claim 3 or 4 wherein the holding means on the sides of the first and second sections consist of tapered surfaces that enclose the remote control units and compress said units within the device.

* * * * *